US010876421B2

(12) United States Patent
Matsumoto

(10) Patent No.: US 10,876,421 B2
(45) Date of Patent: Dec. 29, 2020

(54) ROTARY MACHINE

(71) Applicant: MITSUBISHI HEAVY INDUSTRIES, LTD., Tokyo (JP)

(72) Inventor: Kazuyuki Matsumoto, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 36 days.

(21) Appl. No.: 16/281,427

(22) Filed: Feb. 21, 2019

(65) Prior Publication Data

US 2019/0277151 A1 Sep. 12, 2019

(30) Foreign Application Priority Data

Mar. 9, 2018 (JP) ..... 2018-043508

(51) Int. Cl.
*F01D 11/08* (2006.01)
*F01D 25/06* (2006.01)
*F01D 9/04* (2006.01)

(52) U.S. Cl.
CPC ..... *F01D 11/08* (2013.01); *F01D 9/04* (2013.01); *F01D 25/06* (2013.01); *F05D 2220/31* (2013.01); *F05D 2240/55* (2013.01); *F05D 2260/96* (2013.01)

(58) Field of Classification Search
CPC . F01D 11/08; F01D 9/04; F01D 25/06; F01D 21/003; F05D 2220/31; F05D 2240/55; F05D 2260/96; F05D 2270/334; G01H 1/003; G01H 1/006
See application file for complete search history.

(56) References Cited

U.S. PATENT DOCUMENTS

2014/0119901 A1* 5/2014 Shibata ..... F01D 11/08 415/173.1
2016/0047265 A1 2/2016 Matsumoto et al.

FOREIGN PATENT DOCUMENTS

| | | |
|---|---|---|
| JP | 2006-104952 | 4/2006 |
| JP | 2007-120476 | 5/2007 |
| JP | 2010-159667 | 7/2010 |
| JP | 2011141015 A * | 7/2011 |
| JP | 2013-076341 | 4/2013 |
| JP | 2014-141912 | 8/2014 |
| WO | 2014/162767 | 10/2014 |

* cited by examiner

*Primary Examiner* — Nathaniel E Wiehe
*Assistant Examiner* — Eric A Lange
(74) *Attorney, Agent, or Firm* — Wenderoth, Link & Ponack, L.L.P.

(57) ABSTRACT

There is provided a rotary machine including a rotary shaft configured to rotate around an axis; rotor blades; a casing surrounding the rotor blades radially outside the rotor blades, and in which a recessed portion accommodates tips of the rotor blades; a sealing portion extending from one of a bottom portion of the recessed portion and the tip of the rotor blade, and having a clearance with the other; and a variable breaker installed in the casing and is capable of being displaced between a protrusion position where the variable breaker protrudes into the recessed portion and an accommodation position where the variable breaker is accommodated in the casing.

11 Claims, 8 Drawing Sheets

ROTARY MACHINE

BACKGROUND OF THE INVENTION

Field of the Invention

The present invention relates to a rotary machine.

Priority is claimed on Japanese Patent Application No. 2018-043508, filed on Mar. 9, 2018, the content of which is incorporated herein by reference.

Description of Related Art

A steam turbine includes a rotor that rotates around an axis; a plurality of rotor blades attached to the rotor; a casing that covers the rotor and the rotor blades from the outside; and a plurality of stator blades attached to an inner surface of the casing. High-temperature and high-pressure steam flows into the steam turbine from one side in an axial direction, and thus energy is applied to the rotor blades, and a rotary shaft rotates. A generator or the like connected with the steam turbine is driven by the rotational energy.

In such steam turbine, typically, a predetermined clearance is provided between a tip portion (shroud) of the rotor blade and an inner peripheral surface of the casing to allow smooth rotation of the rotor. Because steam flowing through the clearance flows downstream without colliding with the rotor blades or the stator blades, the steam does not contribute to the rotation of the rotor. The steam flowing through the clearance contains swirl components (speed components in a peripheral direction). The pressure distribution in the clearance becomes non-uniform due to such swirl components, and as a result, vibration may occur in the rotor. Therefore, technology of decreasing the swirl components is desirable.

Japanese Unexamined Patent Application, First Publication No. 2006-104952 discloses an apparatus as an example of such technology. In the apparatus, a guiding blade for guiding a flow direction of steam is provided in a nozzle portion of the stator blade positioned upstream of the shroud of the rotor blade. It is possible to decrease the swirl components, and restrict vibration of the rotor by virtue of the guiding blade.

SUMMARY OF THE INVENTION

It is known that leakage steam containing swirl components promotes (assists) the rotation of the rotor by virtue of frictional force occurring between the rotor and the leakage steam. In the configuration of the apparatus disclosed in Japanese Unexamined Patent Application, First Publication No. 2006-104952, vibration of the rotor can be restricted, and on the other hand, the frictional force also decreases along with the decreasing of swirl components. As a result, a force to rotate the rotor in the peripheral direction becomes weak, and an output of the turbine further decreases compared to when no guiding blades are provided. Therefore, the apparatus is desirably capable of decreasing swirl components only when necessary.

The present invention has been made to solve the problem, and an object of the present invention is to provide a steam turbine in which vibration and an output decrease can be restricted.

Solution to the Problem

According to a first aspect of the present invention, there is provided a rotary machine including a rotary shaft configured to rotate around an axis; a plurality of rotor blades extending outward from the rotary shaft in a radial direction of the rotary shaft and are provided with gaps therebetween in a peripheral direction of the rotary shaft; a casing surrounding the rotor blades radially outside the rotor blades, and in which a recessed portion as a cavity accommodates tips of the rotor blades; a sealing portion extending from one of a bottom portion of the recessed portion and the tip of the rotor blade, and having a clearance with the other; and a variable breaker installed in the casing and is capable of being displaced between a protrusion position where the variable breaker protrudes into the cavity and an accommodation position where the variable breaker is accommodated in the casing.

According to the configuration, when the variable breaker is at the protrusion position, it is possible to decrease and restrict the swirl component inside the cavity by virtue of the variable breaker. On the other hand, when the variable breaker is at the accommodation position, the swirl component smoothly flows inside the cavity. In this case, because the swirl component pulls the tip of the rotor blade in a rotation direction, it is possible to recover part of the energy of the swirl component as a rotational energy of a rotor.

According to such configuration, when vibration occurs in the rotary shaft, it is possible to displace the minimum number of the variable breakers to the protrusion position, which are required to allow the vibration to converge. When vibration converges, it is possible to displace the variable breaker to the accommodation position. Therefore, it is possible to restrict vibration caused by the swirl component while minimizing an output decrease of the steam turbine.

According to a second aspect of the present invention, the variable breaker may be capable of pivoting around a pivotal shaft extending in the radial direction with respect to the axis.

According to the configuration, it is possible to displace the variable breaker to the protrusion position by only allowing the variable breaker to pivot around the pivotal shaft. Therefore, it is possible to decrease the swirl component. Any type of a driving source can be adopted if the driving source can apply rotation force to the variable breaker. Therefore, it is possible to simplify the configuration of the apparatus, and reduce costs. On the other hand, when the variable breaker is accommodated at the accommodation position, because the swirl component is not blocked, it is possible to operate the turbine at the same output as that of a turbine without swirl breakers installed.

According to a third aspect of the present invention, the variable breaker may be capable of retractably advancing from the casing into the cavity in the radial direction with respect to the axis.

According to the configuration, the variable breaker advances and retracts from the inside of the cavity in the radial direction with respect to the axis. A flow (swirl component) containing a peripheral component with respect to the axis is formed inside the cavity. Therefore, when the variable breaker is at the protrusion position, it is possible to efficiently block the swirl component via the variable breaker. On the other hand, when the variable breaker is accommodated at the accommodation position, because the swirl component is not blocked, it is possible to operate the turbine at the same output as that of a turbine without swirl breakers installed.

According to a fourth aspect of the present invention, the variable breaker may be capable of retractably advancing from the casing into the cavity in a direction of the axis.

According to the configuration, the variable breaker advances and retracts from the inside of the cavity in the axial direction. A flow (swirl component) containing a peripheral component with respect to the axis is formed inside the cavity. Therefore, when the variable breaker is at the protrusion position, it is possible to efficiently block the swirl component via the variable breaker. On the other hand, when the variable breaker is accommodated at the accommodation position, because the swirl component is not blocked, it is possible to operate the turbine at the same output as that of a turbine without swirl breakers installed.

According to a fifth aspect of the present invention, the casing may be provided with a fixing groove extending in the radial direction with respect to the axis, and when the variable breaker is at the protrusion position, at least part of the variable breaker is restricted by the fixing groove.

According to the configuration, when the variable breaker is at the protrusion position, at least part of the variable breaker is fixed to the fixing groove such that the variable breaker is not capable of being displaced in the peripheral direction. Therefore, the variable breaker can sufficiently resist the swirl component colliding with the variable breaker in the peripheral direction. In other words, it is possible to reduce the possibility that the variable breaker is blown away or bent by the swirl component.

According to a sixth aspect of the present invention, a plurality of the variable breakers may be installed such that the variable breakers are equally spaced from each other in the peripheral direction with respect to the axis.

According to the configuration, because the plurality of variable breakers are provided while being equally spaced from each other in the peripheral direction, even when the variable breakers are at the protrusion position, it is possible to achieve a uniform peripheral pressure distribution inside the casing. That is, it is possible to restrict a pressure unbalance in the peripheral direction, which is caused by the disposition of the variable breakers.

According to a seventh aspect of the present invention, the rotary machine may further include a vibration detection unit configured to detect vibration of the rotary shaft, and a control device configured to displace the variable breaker to the protrusion position when the vibration detection unit detects the vibration, and to displace the variable breaker to the accommodation position when the vibration of the rotary shaft is not detected.

According to the configuration, when vibration of the rotary shaft is detected, it is possible to decrease the swirl component, and restrict the vibration by displacing the variable breakers to the protrusion position. When vibration converges, it is possible to restrict an output decrease of the steam turbine by displacing the variable breakers to the accommodation position. That is, it is possible to operate the turbine at the same output as that of a turbine without swirl breakers installed.

According to an eighth aspect of the present invention, the rotary machine may further include a vibration detection unit configured to detect vibration of the rotary shaft, and a control device configured to displace the variable breaker to the protrusion position when the vibration detection unit detects the vibration, and to displace the variable breaker to the accommodation position when the vibration of the rotary shaft is not detected. The control device may determine the number of the variable breakers, which are to be displaced to the protrusion position, in response to an intensity of vibration of the rotary shaft.

According to the configuration, the number of the variable breakers, which are to be displaced to the protrusion position, is determined in response to the intensity of vibration of the rotary shaft. That is, when the intensity of vibration is high, it is possible to displace a larger number of the variable breakers to the protrusion position. Therefore, it is possible to allow the vibration to early converge. On the other hand, when the intensity of vibration is low, it is possible to allow vibration to converge while restricting an output decrease of the steam turbine by displacing the minimum number of the variable breakers to the protrusion position.

According to a ninth aspect of the present invention, as the intensity of vibration of the rotary shaft increases, the control device may increase the number of the variable breakers which are to be displaced from the accommodation position to the protrusion position, and displace a plurality of the variable breakers to the protrusion position such that the variable breakers are equally spaced from each other in the peripheral direction.

According to the configuration, when the intensity of vibration is high, it is possible to displace a larger number of the variable breakers to the protrusion position. Therefore, it is possible to allow the vibration to early converge. Because the variable breakers are disposed while being equally spaced from each other in the peripheral direction, even when the variable breakers are at the protrusion position, it is possible to achieve a uniform peripheral pressure distribution inside the casing. That is, it is possible to restrict a pressure unbalance in the peripheral direction, which is caused by the disposition of the variable breakers.

According to the present invention, it is possible to restrict vibration, and minimize an output decrease.

DETAILED DESCRIPTION OF THE INVENTION

First Embodiment

Figure 1:
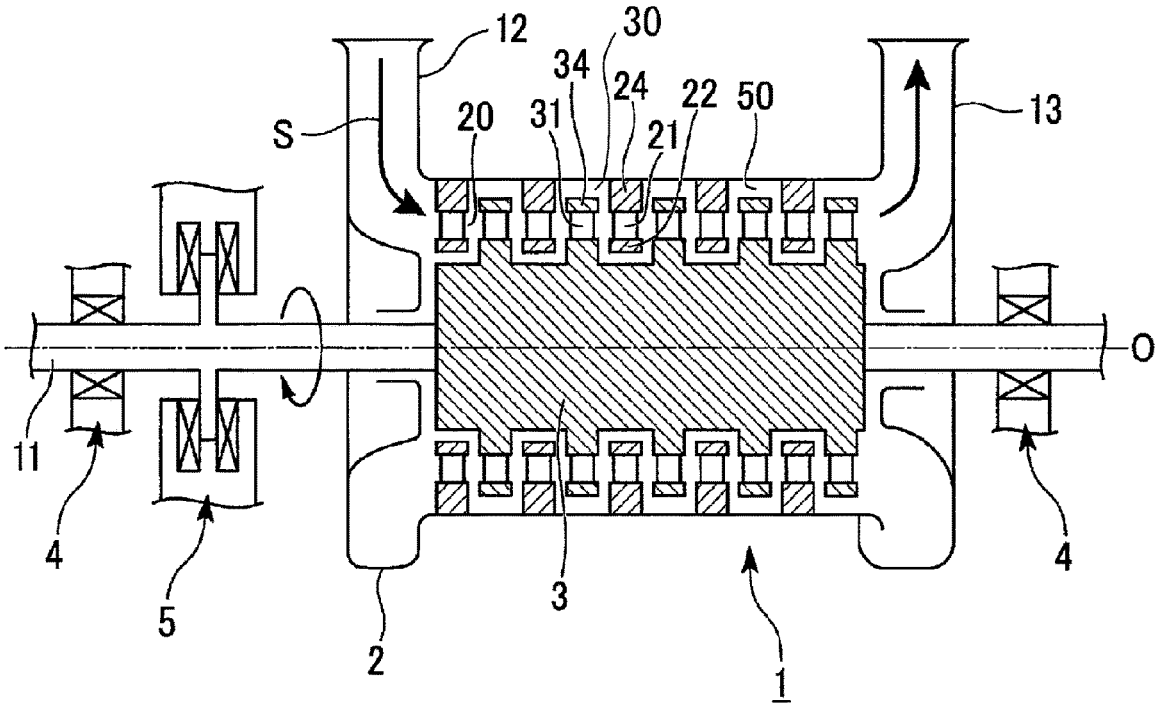
FIG. 1 is a view showing a configuration of a steam turbine according to a first embodiment of the present invention.

A first embodiment of the present invention will be described with reference to the drawings. As shown in FIG. 1, a steam turbine 1 includes a rotor (rotary shaft) 3 which extends along the direction of an axis O; a casing 2 which covers the rotor 3 from an outer peripheral side; journal bearings 4 which support shaft ends 11 of the rotor 3 such that the rotor 3 can rotate around the axis O; and a thrust bearing 5.

The rotor 3 has a plurality of rotor blades 30. The plurality of rotor blades 30 are arranged with predetermined gaps therebetween in a peripheral direction of the rotor 3. A plurality of rows of the rotor blades 30 are arranged with predetermined gaps therebetween even in the direction of the axis O. The rotor blade 30 has a blade body 31 and a rotor blade shroud (shroud) 34. The blade body 31 protrudes outward from an outer peripheral surface of the rotor 3 in a radial direction. The blade body 31 has a blade-shaped cross section as seen in the radial direction. The rotor blade shroud 34 is provided in a tip portion (outer end portion in the radial direction) of the blade body 31.

The casing 2 has a substantially cylindrical shape and covers the rotor 3 from the outer peripheral side. A steam supply pipe 12 for suctioning steam is provided on one side of the casing 2 in the direction of the axis O. A steam exhaust pipe 13 for exhausting steam is provided on the other side of the casing 2 in the direction of the axis O. In the description hereinbelow, an upstream side refers to a side where the steam supply pipe 12 is positioned in the viewpoint of the steam exhaust pipe 13. A downstream side refers to a side where the steam exhaust pipe 13 is positioned in the viewpoint of the steam supply pipe 12.

A plurality of stator blades 21 are provided along an inner peripheral surface of the casing 2. The stator blade 21 is a blade-shaped member that is connected to the inner peripheral surface of the casing 2 via a stator blade base 24. A stator blade shroud 22 is provided in a tip portion (inner end portion in the radial direction) of the stator blade 21. Similar to the rotor blade 30, the plurality of stator blades 21 are arranged on the inner peripheral surface along the peripheral direction and the direction of the axis O. The rotor blade 30 is disposed in a region between the plurality of stator blades 21 adjacent to each other.

A main flow passage 20 is formed by a region in which the stator blades 21 and the rotor blades 30 are arranged inside the casing 2, and steam S which is a working fluid flows through the main flow passage 20. A recessed portion 50 is formed in the entire peripheral region between the inner peripheral surface of the casing 2 and the rotor blade shrouds 34, and is recessed outward in the radial direction with respect to the axis O. The recessed portion 50 forms a cavity that accommodates tips (rotor blade shrouds 34) of the rotor blades 30. That is, the recessed portion 50 has a sufficiently large volume compared to the volume of the rotor blade shrouds 34.

The steam S is supplied to the steam turbine 1 with the foregoing configuration via the steam supply pipe 12 on the upstream side. Thereafter, as the rotor 3 rotates, the steam S passes through the rows of the stator blades 21 and the rotor blades 30, and shortly thereafter, is exhausted to a subsequent apparatus (not shown) via the steam exhaust pipe 13 on the downstream side. The steam S also flows into the recessed portions 50 when passing through the rows of the stator blades 21 and the rotor blades 30.

The journal bearings 4 support a load applied in the radial direction with respect to the axis O. The journal bearings 4 are respectively provided at both ends of the rotor 3. The thrust bearing 5 supports a load applied in the direction of the axis O. The thrust bearing 5 is provided in only an upstream end portion of the rotor 3.

Figure 2:
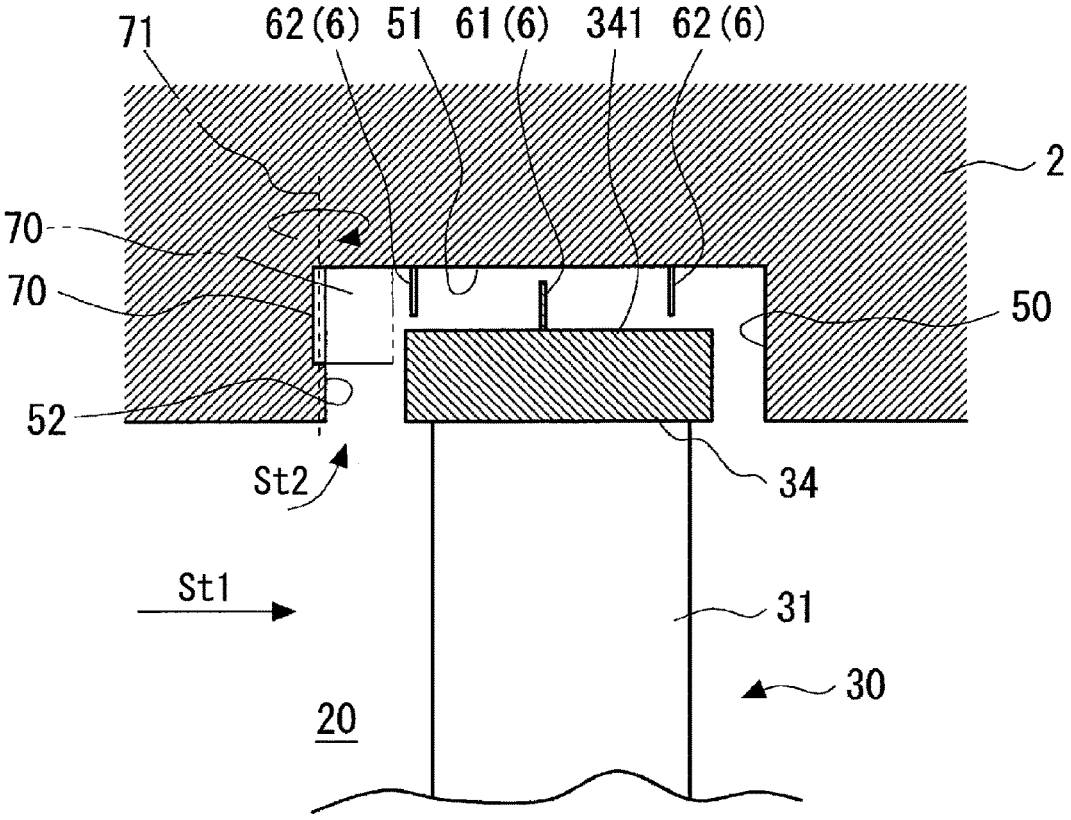
FIG. 2 is an enlarged view of a variable breaker according to the first embodiment of the present invention.

FIG. 2 shows the periphery of the recessed portion 50 in an enlarged manner. A sealing fin 6 is provided on at least one of a tip (shroud outer peripheral surface 341) of the rotor blade shroud 34 and a surface (which faces an inner peripheral side) (recessed portion bottom surface 51) of the recessed portion 50 and between the shroud outer peripheral surface 341 and the recessed portion bottom surface 51, and protrudes to the other. The sealing fin 6 is provided to prevent a flow (leakage flow St2) of steam from diverging from steam (main steam St1) flowing through the main flow passage 20, and from flowing to the recessed portion 50.

In the embodiment, one sealing fin 6 (shroud side sealing fin 61) is provided on the shroud outer peripheral surface 341, and two sealing fins 6 (recessed portion side sealing fins 62) are provided on the recessed portion bottom surface 51. The shroud side sealing fin 61 is disposed between two recessed portion side sealing fins 62. Small gaps (clearances) widening in the radial direction are formed between the shroud side sealing fin 61 and the recessed portion bottom surface 51 and between the recessed portion side sealing fins 62 and the shroud outer peripheral surface 341.

Figure 3:
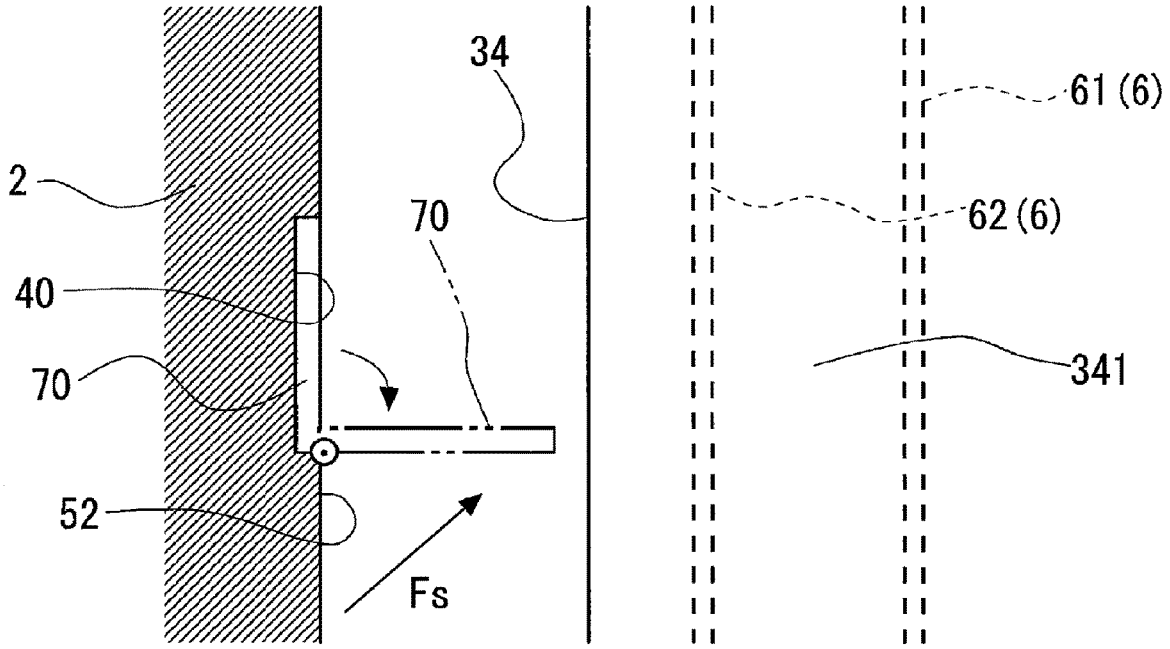
FIG. 3 is a view of the variable breaker according to the first embodiment of the present invention as seen in a radial direction.

As shown in FIGS. 2 and 3, a variable breaker 70 is provided on a surface (recessed portion upstream surface 52) of the recessed portion 50, which is positioned upstream. The variable breaker 70 is provided to block a swirl component (swirling flow component) Fs that is contained in the leakage flow St2 diverging from the main steam St1 and flowing inside the recessed portion 50. The variable breaker 70 has a rectangular plate-like shape. The variable breaker 70 can pivot around a pivotal shaft 71 extending in the radial direction with respect to the axis O. The pivotal shaft 71 is attached to the recessed portion upstream surface 52, and supports an edge of the variable breaker 70, which is positioned on one side in the peripheral direction.

An accommodation groove 40, which is required to have the same area and depth (dimension in the direction of the axis O) as those of the variable breaker 70, is formed in the recessed portion upstream surface 52. The pivotal shaft 71 is attached to an edge of the accommodation groove 40, which is positioned on one side in the peripheral direction. The variable breaker 70 pivots around the pivotal shaft 71 via a driving force transmitted from a driving source 72 (refer to FIG. 4), and thus, can be displaced between an accommodation position where the variable breaker 70 is accommodated in the accommodation groove 40 and a protrusion position where the variable breaker 70 protrudes into the recessed portion 50. More specifically, the variable breaker 70 can pivot around the pivotal shaft 71 from the other side to one side in the peripheral direction as seen from an outside in the radial direction. An electric motor, a hydraulic motor, or the like is preferably used as the driving source 72 of the variable breaker 70.

In the description hereinbelow, the displacement of the variable breaker 70 from the accommodation position to the protrusion position may be referred to as "the unfolding of the variable breaker 70". The displacement of the variable breaker 70 from the protrusion position to the accommodation position may be referred to as "the accommodating of the variable breaker 70".

The variable breaker 70 in an unfolded state is substantially perpendicular to the recessed portion upstream surface 52. In other words, the variable breaker 70 in an unfolded state extends inside the recessed portion 50 in the direction of the axis O. When the variable breaker 70 is accommodated, the variable breaker 70 is accommodated in the accommodation groove 40, and a downstream surface (breaker main surface 73) of the variable breaker 70 is flush with the recessed portion upstream surface 52. In other words, when the variable breaker 70 is in the accommodation groove 40, no step is formed between the variable breaker 70 and the recessed portion upstream surface 52.

Figure 4:
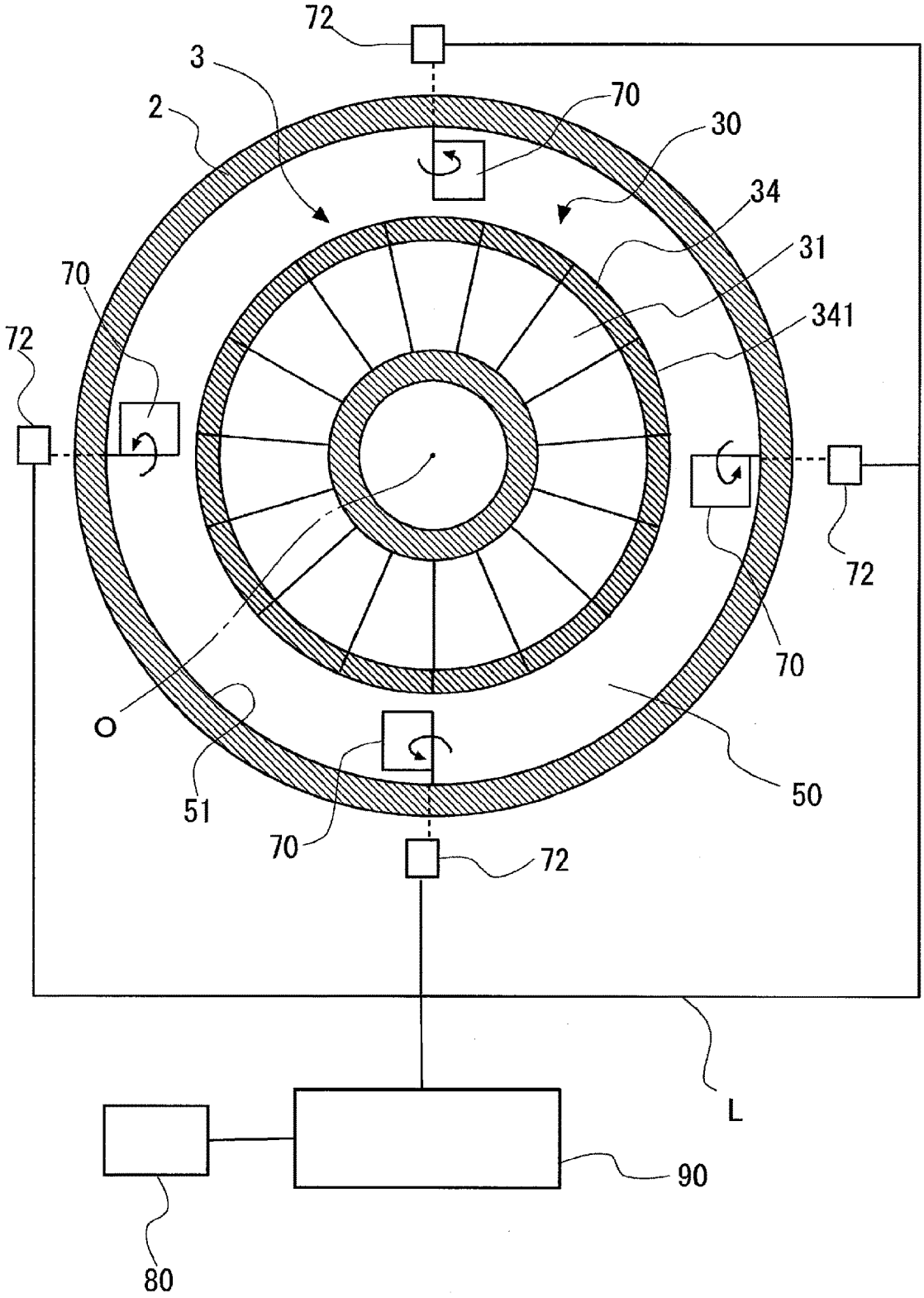
FIG. 4 is a cross-sectional view of the steam turbine according to the first embodiment of the present invention as seen in an axial direction.

In the embodiment, as shown in FIG. 4, a plurality of (four) the variable breakers 70 are provided inside the recessed portion 50 while being equally spaced from each other in the peripheral direction (FIG. 4 shows the rotor blades 30 in a simplified manner. That is, the number of the rotor blades 30 is not limited to the number in the example shown in FIG. 4). The driving source 72 corresponding to each of the variable breakers 70 is connected with the control device 90 via a signal line L. The steam turbine 1 is provided with a vibration sensor 80 that detects vibration of the rotor 3. Specifically, the vibration sensor 80 is attached to the journal bearing 4 or the thrust bearing 5. The vibration sensor 80 transmits the detected vibration of the rotor 3 to the control device 90 as electrical signals.

Figure 5:
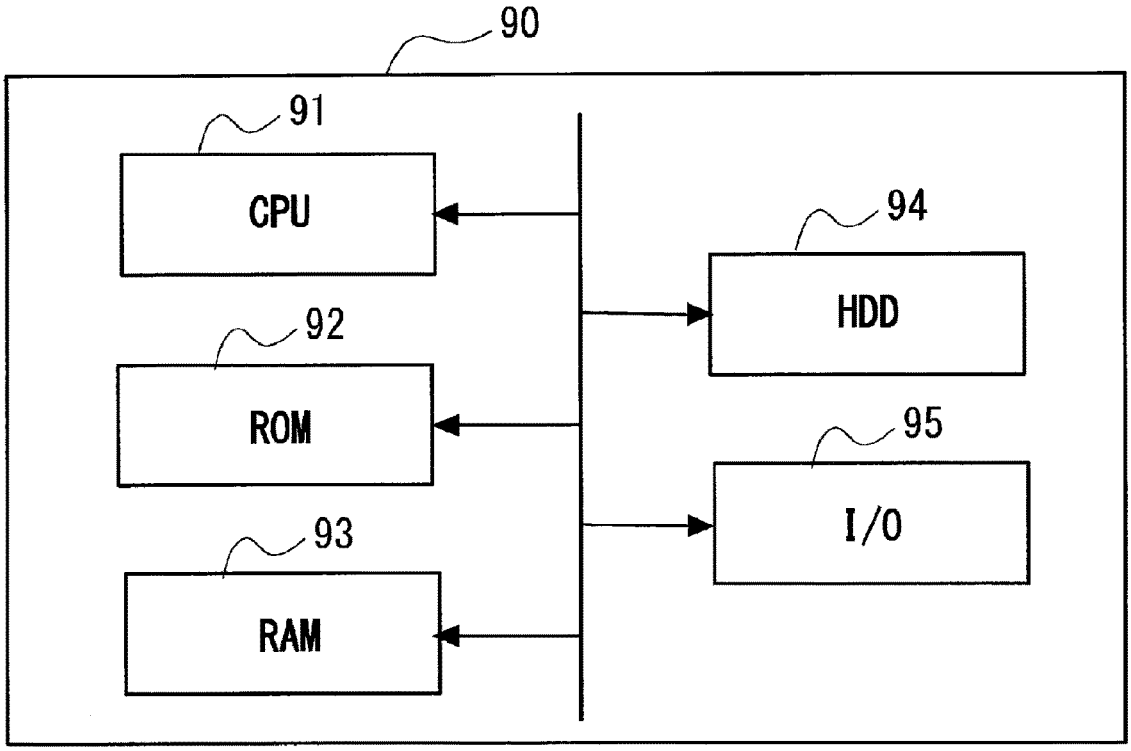
FIG. 5 is a diagram showing a hardware configuration of a control device according to the first embodiment of the present invention.

As shown in FIG. 5, the control device 90 is a computer including a central processing unit (CPU) 91, a read only memory (ROM) 92, a random access memory (RAM) 93, a hard disk drive (HDD) 94, and a signal receiving module (input/output: I/O) 95. The signal receiving module 95 receives signals from the vibration sensor 80. The signal receiving module 95 may receive signals amplified via a charge amplifier or the like.

Figure 6:
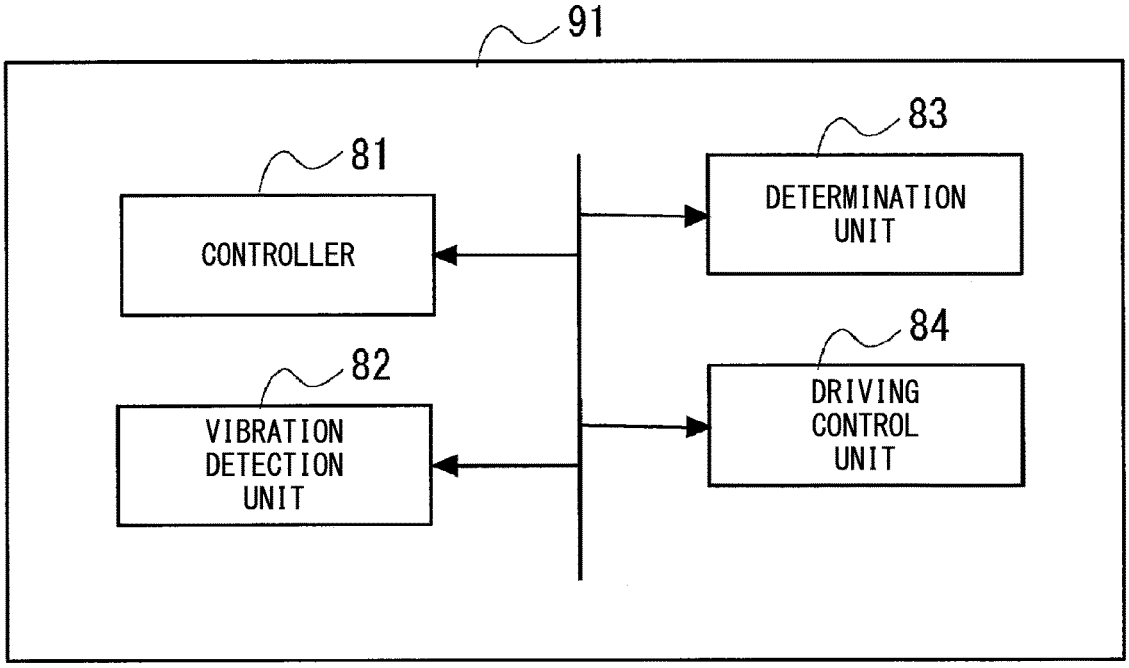
FIG. 6 is a functional block diagram showing a configuration of the control device according to the first embodiment of the present invention.

As shown in FIG. 6, the CPU 91 of the control device 90 executes a program prestored in the device, and has a controller 81, a vibration detection unit 82; a determination unit 83, and a driving control unit 84. The controller 81 controls other functional units of the control device 90. The vibration detection unit 82 receives information (amplitude, frequency, and the like) on the vibration of the rotor 3, which is received from the vibration sensor 80 via the signal receiving module. The determination unit 83 determines whether the vibration of the rotor 3 is greater than a prestored threshold value. The driving control unit 84 transmits drive signals to the driving source 72 based on the determination result of the determination unit 83. The driving source 72 instructs via the driving signals that the variable breaker 70 should be unfolded or accommodated.

Subsequently, an operation of the steam turbine 1 according to the embodiment will be described. In the operation of the steam turbine 1, high-temperature and high-pressure steam is supplied from an outside steam supply source (not shown) to the inside (the main flow passage 20) of the casing 2 via the steam supply pipe 12. The steam forms a flow (the main steam St1) flowing along the main flow passage 20 from the upstream side to the downstream side. The main steam St1 passes through the main flow passage 20 where the stator blades 21 and the rotor blades 30 are provided, thereby imparting rotation force to the rotor 3 via the rotor blades 30. The rotation of the rotor 3 is taken out from a shaft end, and drives external equipment such as a generator (not shown).

Subsequently, a behavior of steam in the vicinity of the recessed portion 50 will be described with reference to FIG. 2. As shown in the same drawing, some components of the main steam St1 forms a flow (the leakage flow St2) that deviates from the main steam St1 and flows into the recessed portion 50. The leakage flow St2 contains a swirl component (swirling flow component) Fs that is imparted when the leakage flow St2 passes by the stator blades 21 provided on the casing 2. As shown in FIG. 3, the swirl component Fs flows frontward (from one side to the other side in the peripheral direction) in the rotation direction of the rotor 3 as travelling from the upstream side to the downstream side.

Figure 7A:
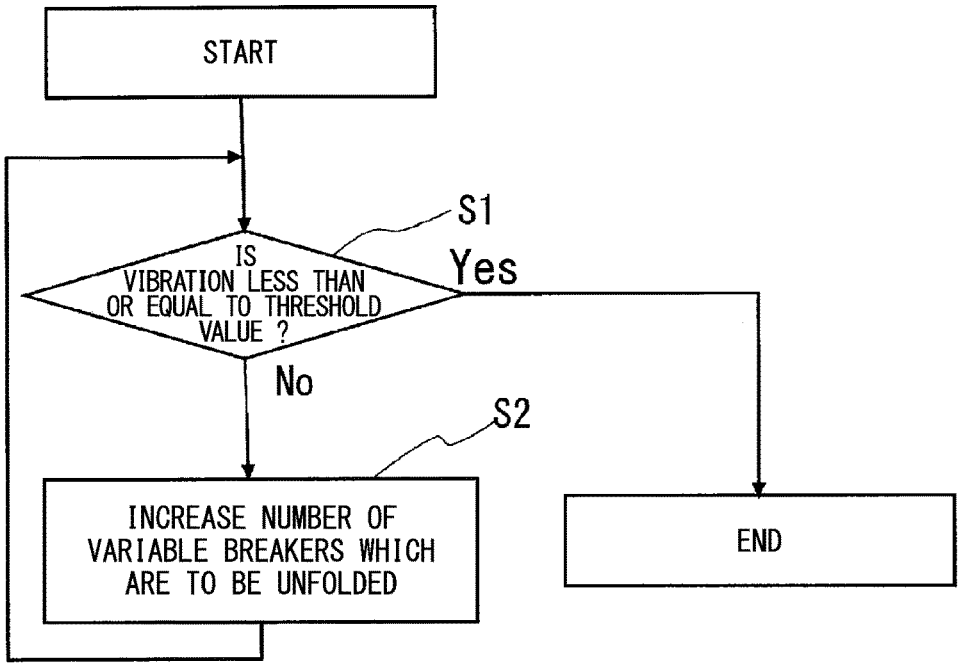
FIG. 7A is a flowchart showing a process performed by the control device according to the first embodiment of the present invention.

As shown in FIG. 7A, when the steam turbine 1 operates, the determination unit 83 performs a comparison in magnitude between the vibration of the rotor 3 and the threshold value (Step S1). When the determination unit 83 determines that the vibration of the rotor 3 is greater than the threshold value (Step S1: No), the driving control unit 84 transmits drive signals to the driving source 72. The variable breaker 70 is unfolded via the driving signals (Step S2). Therefore, the swirl component Fs of the leakage flow St2 flowing inside the recessed portion 50 decreases, and the vibration of the rotor 3 is restricted.

On the other hand, when the determination unit 83 determines that the vibration of the rotor 3 is less than the threshold value (Step S1: Yes), the driving control unit 84 ends the control without transmitting drive signals to the driving source 72. Even thereafter, Steps S1 and S2 are repeatedly executed continuously or intermittently, and thus the vibration of the rotor 3 is monitored.

It is known that the leakage flow St2 containing the swirl component Fs promotes (assists) the rotation of the rotor 3 by virtue of frictional force occurring between the rotor 3 and the leakage flow St2. In the configuration, the vibration of the rotor 3 can be restricted, and on the other hand, the frictional force also decreases along with the decreasing of the swirl component Fs. As a result, a force to rotate the rotor 3 in the peripheral direction may become weak, and an output of the steam turbine 1 may decrease.

In response to the intensity (magnitude in the amplitude of frequency components which may cause an unstable vibration of the rotor) of vibration of the rotor 3, the control device 90 according to the embodiment determines the number of the variable breakers 70 which are unfolded. Specifically, the driving control unit 84 unfolds two of four variable breakers 70 at an initial stage of detection of vibration. The variable breakers 70 which are unfolded are a pair of the variable breakers 70 that face each other in a diameter direction with respect to the axis O. That is, the variable breakers 70 which are unfolded are equally spaced from each other inside the recessed portion 50 in the peripheral direction.

In this state, the determination unit 83 compares a vibration intensity of the rotor 3 with the threshold value again. When it is determined that the vibration intensity of the rotor 3 is still greater than the threshold value, the remaining two variable breakers 70 are unfolded. That is, four variable breakers 70 are unfolded while being equally spaced from each other in the peripheral direction. As such, in the embodiment, as the intensity of vibration of the rotor 3 increases, the number of the variable breakers 70 to be unfolded increases.

Even thereafter, the determination unit 83 continuously or intermittently repeats a comparison in magnitude between the vibration intensity and the threshold value. When it is determined that the vibration intensity of the rotor 3 is less than the threshold value, the driving control unit 84 instructs that two of the variable breakers 70 should be accommodated, which face each other in the diameter direction. When it is determined that the vibration intensity of the rotor 3 is still less than the threshold value, the driving control unit 84 instructs that the remaining two variable breakers 70 should be accommodated.

As described above, in the steam turbine 1 according to the embodiment, when the variable breaker 70 is at the protrusion position, it is possible to decrease and restrict the swirl component inside the recessed portion 50 by virtue of the variable breaker 70. On the other hand, when the variable breaker 70 is at the accommodation position, because the swirl component smoothly flows inside the recessed portion 50, the swirl component Fs pulls the tip of the rotor blade 30 in the rotation direction. Therefore, it is possible to recover part of the energy of the swirl component as a rotational energy of the rotor. That is, according to the configuration, it is possible to displace the variable breaker 70 to the protrusion position when vibration occurs in the rotor 3, and displace the variable breaker 70 to the accommodation position when vibration converges. Therefore, it is possible to restrict vibration caused by the swirl component while minimizing an output decrease of a steam turbine 1.

According to the configuration, it is possible to displace the variable breaker 70 to the protrusion position by only allowing the variable breaker 70 to pivot around the pivotal shaft 71. Any type of a driving source can be used as the driving source 72 if the driving source can apply rotation force to the variable breaker 70. Therefore, it is possible to simplify the configuration of the apparatus, and reduce costs. On the other hand, when the variable breaker 70 is accommodated at the accommodation position, because the swirl component is not blocked, it is possible to operate the steam turbine 1 at the same output as that of a turbine without swirl breakers installed.

According to the configuration, when the vibration sensor 80 detects vibration of the rotor 3, it is possible to decrease the swirl component Fs, and restrict the vibration by displacing the variable breaker 70 to the protrusion position. When vibration converges, it is possible to restrict an output decrease of the steam turbine 1 by displacing the variable breaker 70 to the accommodation position. That is, it is possible to further restrict an output decrease of the steam turbine 1 compared to when swirl breakers or the like are provided.

According to the configuration, because the plurality of variable breakers 70 are provided while being equally spaced from each other in the peripheral direction, even when the variable breakers 70 are at the protrusion position, it is possible to achieve a uniform peripheral pressure distribution inside the casing 2. That is, it is possible to restrict a pressure unbalance in the peripheral direction, which is caused by the disposition of the variable breakers 70.

According to the configuration, the number of the variable breakers 70, which are to be unfolded, is determined in response to the intensity of vibration of the rotor 3. That is, when the intensity of vibration is high, it is possible to displace a larger number of the variable breakers 70 to the protrusion position. Therefore, it is possible to allow the vibration to early converge. On the other hand, when the intensity of vibration is low, it is possible to allow vibration to converge while minimizing an output decrease of the steam turbine 1 by unfolding the minimum number of the variable breakers 70.

The first embodiment of the present invention has been described above. Various forms of modifications or improvements can be made to the configuration without departing from the spirit of the present invention. In the example of the embodiment, four variable breakers 70 are disposed in the peripheral direction. However, the number of the variable breakers 70 is not limited to four, and may be greater than or equal to five. Desirably, the number of the variable breakers 70 is an even number from the viewpoint of a uniform peripheral pressure distribution.

In the embodiment, it is possible to selectively displace each of the variable breakers 70 between the accommodation position and the protrusion position. However, it is also possible to continuously change a pivot amount (position or posture) of the variable breaker 70 between the accommodation position and the protrusion position. According to such configuration, it is possible to more precisely adjust a decrease amount of the swirl component Fs.

In the configuration of the embodiment, the variable breaker 70 is unfolded around the pivotal shaft 71 from the other side to one side in the peripheral direction. That is, in the embodiment, the variable breaker 70 is unfolded in a direction opposite to the swirl component Fs flowing from one side to the other side in the peripheral direction. However, the unfolding direction of the variable breaker 70 is not limited to the direction described above, and it is possible to adopt a configuration where the variable breaker 70 is unfolded around the pivotal shaft 71 from one side to the other side in the peripheral direction.

Figure 8:
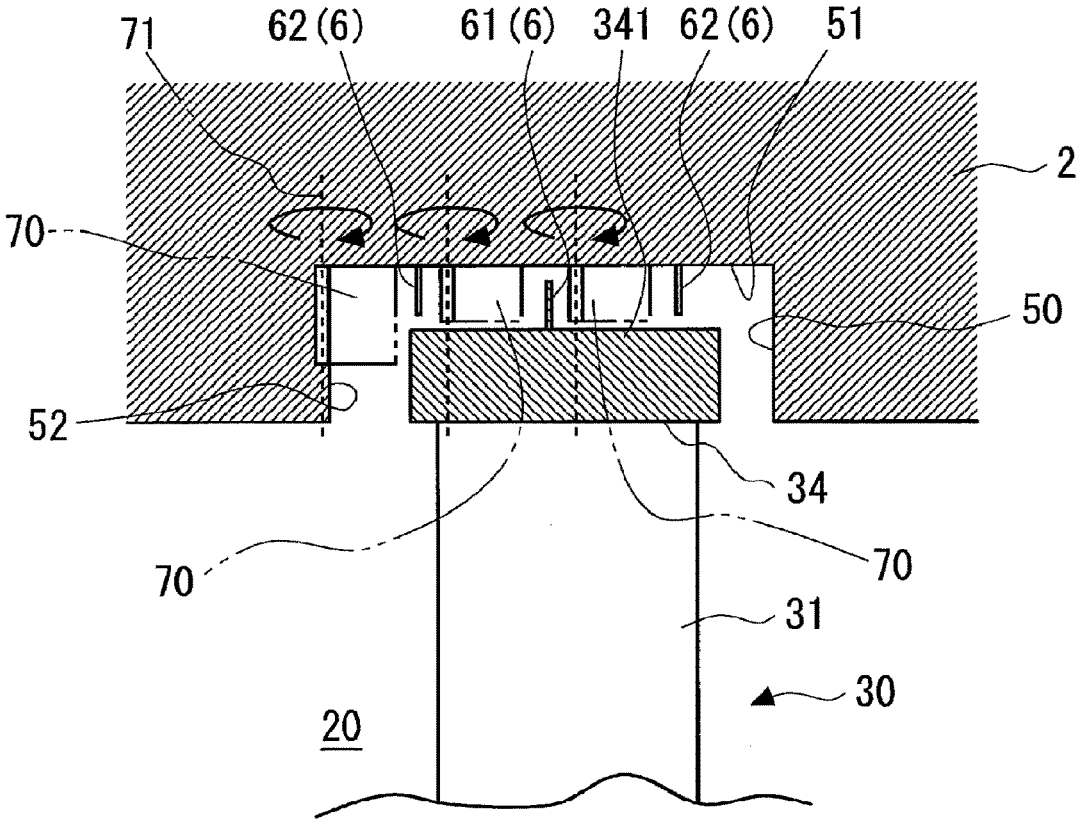
FIG. 8 is a view showing a modification example of the variable breaker according to the first embodiment of the present invention.

In the example of the embodiment, the variable breaker 70 is disposed in the recessed portion upstream surface 52. However, the position where the variable breaker 70 is disposed is not limited to the position described above. As shown in FIG. 8, as another example, it is possible to dispose the variable breaker 70 in a space between the sealing fins 6 adjacent to each other.

Figure 9:
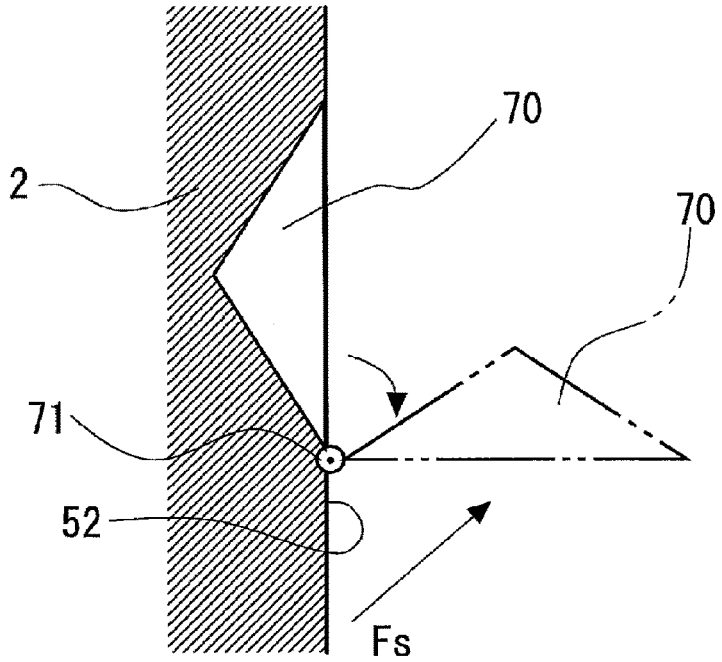
FIG. 9 is a view showing another modification example of the variable breaker according to the first embodiment of the present invention.

In the example of the embodiment, the variable breaker 70 has a rectangular plate-like shape. However, the shape of the variable breaker 70 is not limited to the shape described above. As shown in FIG. 9, a member having a triangular cross section as seen in the radial direction can be used as the variable breaker 70.

In the example of the embodiment, the control device 90 executes Steps S1 and S2 shown in FIG. 7A. However, the operation of the control device 90 is not limited to the operation described above, and the control device 90 can execute an operation shown in FIG. 7B, which is another example.

Figure 7B:
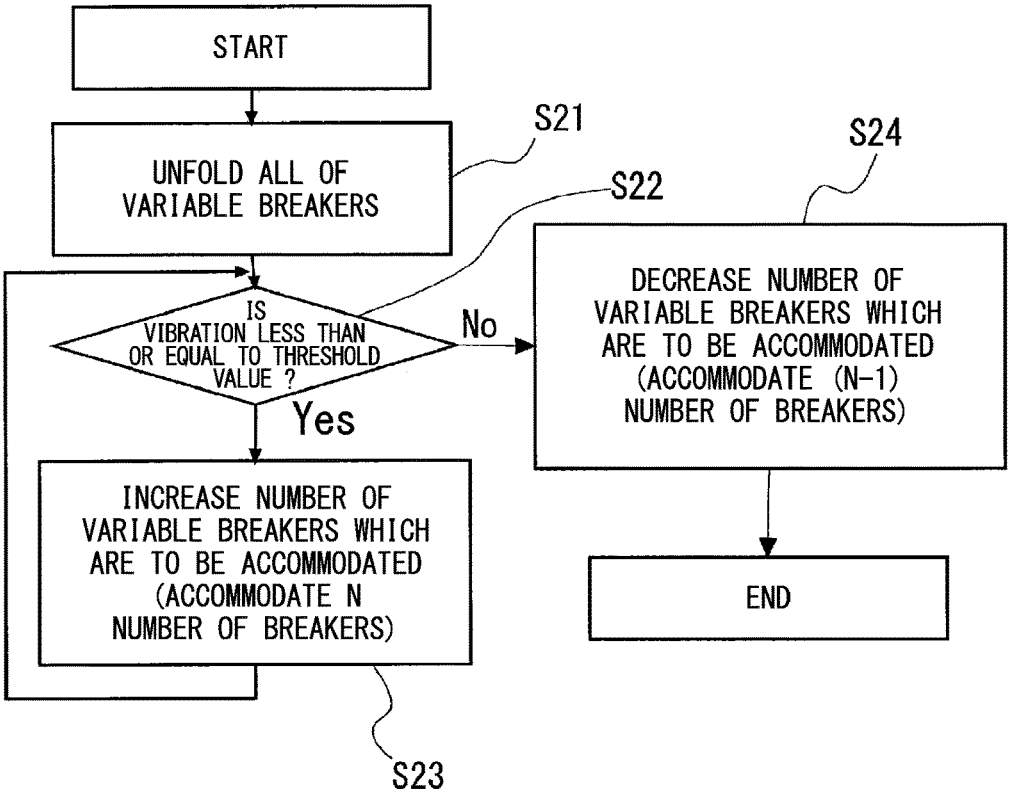
FIG. 7B is a flowchart showing a process performed by a control device according to a modification example of the first embodiment of the present invention.

In the example of FIG. 7B, regardless of whether vibration occurs, the control device 90 unfolds all of the variable breakers 70 at the beginning (Step S21). Subsequently, the determination unit 83 compares a vibration intensity of the rotor 3 with the threshold value (Step S22). When the determination unit 83 determines that the vibration intensity is less than or equal to the threshold value (Step S22: Yes), the control device 90 (the driving control unit 84) instructs that only a predetermined n number of the variable breakers 70 should be accommodated (Step S23). Desirably, the value of n is appropriately determined in response to an operation record or output of the steam turbine 1.

After Step S23 is executed, the determination unit 83 compares the vibration intensity with the threshold value again. When the determination unit 83 determines that the vibration intensity is greater than or equal to the threshold value (Step S22: No), it is possible to consider the determination result as a recurrence of vibration of the rotor 3 due to a large number of the variable breakers 70 being accommodated in Step S23. The control device 90 (the driving control unit 84) reduces the number of the variable breakers 70 by one, which are to be accommodated. That is, one variable breaker 70 is unfolded such that (n−1) number of the variable breakers 70 are accommodated (Step S24).

According to the embodiment, it is possible to unfold only a number of the variable breakers 70 which are required to restrict the vibration of the rotor 3. That is, it is possible to realize an operation condition with high accuracy, under which it is possible to minimize an output decrease of the steam turbine 1 while decreasing the vibration of the rotor 3.

In the embodiment, the steam turbine 1 is an example of a rotary machine. However, the form of the rotary machine is not limited to the steam turbine 1, and the rotary machine may be a centrifugal compressor or a gas turbine.

Second Embodiment

Figure 10:
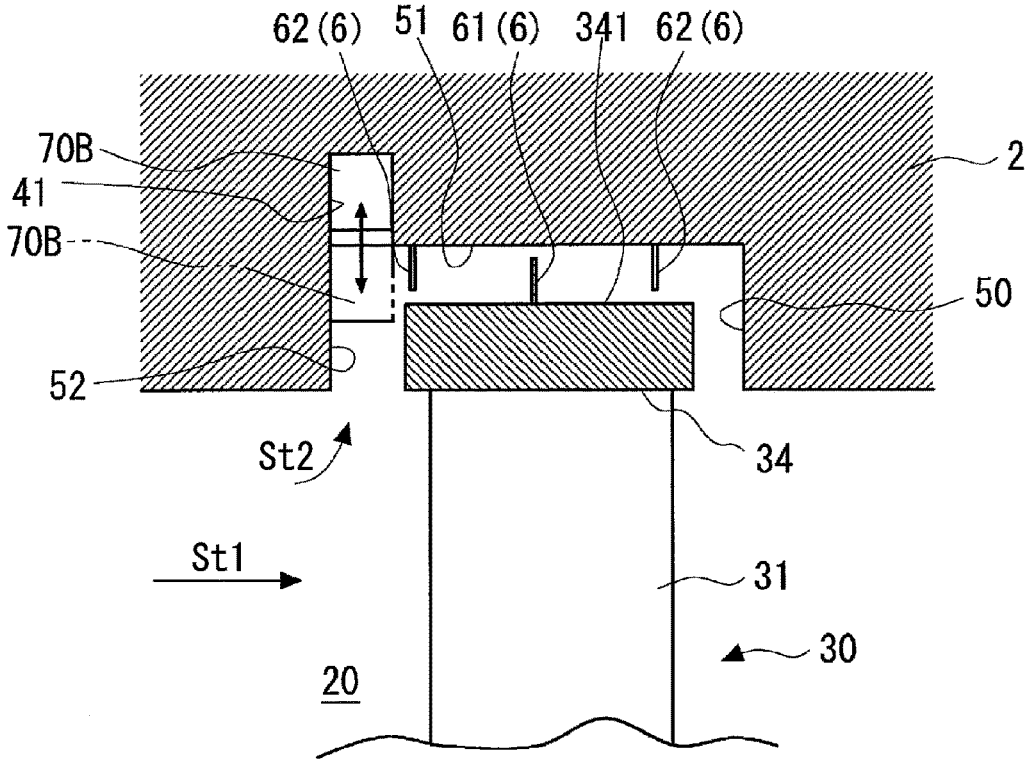
FIG. 10 is a view of a variable breaker according to a second embodiment of the present invention as seen in the radial direction.

Subsequently, a second embodiment of the present invention will be described with reference to FIG. 10. The same reference signs will be assigned to the same components as in the first embodiment, and detailed descriptions thereof will be omitted. As shown in the same drawing, in the embodiment, an accommodation groove 41 is formed in the recessed portion bottom surface 51, and extends in the radial direction with respect to the axis O. More specifically, the accommodation groove 41 is formed alongside of an upstream edge of the recessed portion bottom surface 51. The accommodation groove 41 can accommodate a variable breaker 70B having a rectangular plate-like shape.

The variable breaker 70B can be displaced between an accommodation position where the variable breaker 70B is accommodated in the accommodation groove 41 and a protrusion position where the variable breaker 70B protrudes inward from the accommodation groove 41 in the radial direction. That is, the variable breaker 70B can advance and retract into the accommodation groove 41 in the radial direction. When the variable breaker 70B is at the protrusion position, the accommodation groove 41 supports an edge of the variable breaker 70B, which is positioned on the outside in the radial direction. Similar to the first embodiment, also in the embodiment, a plurality of the variable breakers 70B are provided inside the recessed portion 50 while being equally spaced from each other in the peripheral direction.

According to the configuration, the variable breaker 70B advances and retracts from the inside of the recessed portion 50 in the radial direction with respect to the axis O. A flow (swirl component) containing a peripheral component with respect to the axis O is formed inside the recessed portion 50. Therefore, when the variable breaker 70B is at the protrusion position, it is possible to efficiently block the swirl component via the variable breaker 70B. On the other hand, when the variable breaker 70B is accommodated at the accommodation position, because the swirl component is not blocked, it is possible to operate the steam turbine 1 at the same output as that of a turbine without swirl breakers installed.

The second embodiment of the present invention has been described above. Various forms of modifications or improvements can be made to the configuration without departing from the spirit of the present invention. In the embodiment, it is possible to selectively displace the variable breaker 70B between the accommodation position and the protrusion position. However, it is also possible to continuously change an advance amount of the variable breaker 70B between the accommodation position and the protrusion position. According to such configuration, it is possible to more precisely adjust a decrease amount of the swirl component Fs.

In the embodiment, the steam turbine 1 is an example of a rotary machine. However, the form of the rotary machine is not limited to the steam turbine 1, and the rotary machine may be a centrifugal compressor or a gas turbine.

Third Embodiment

Figure 11:
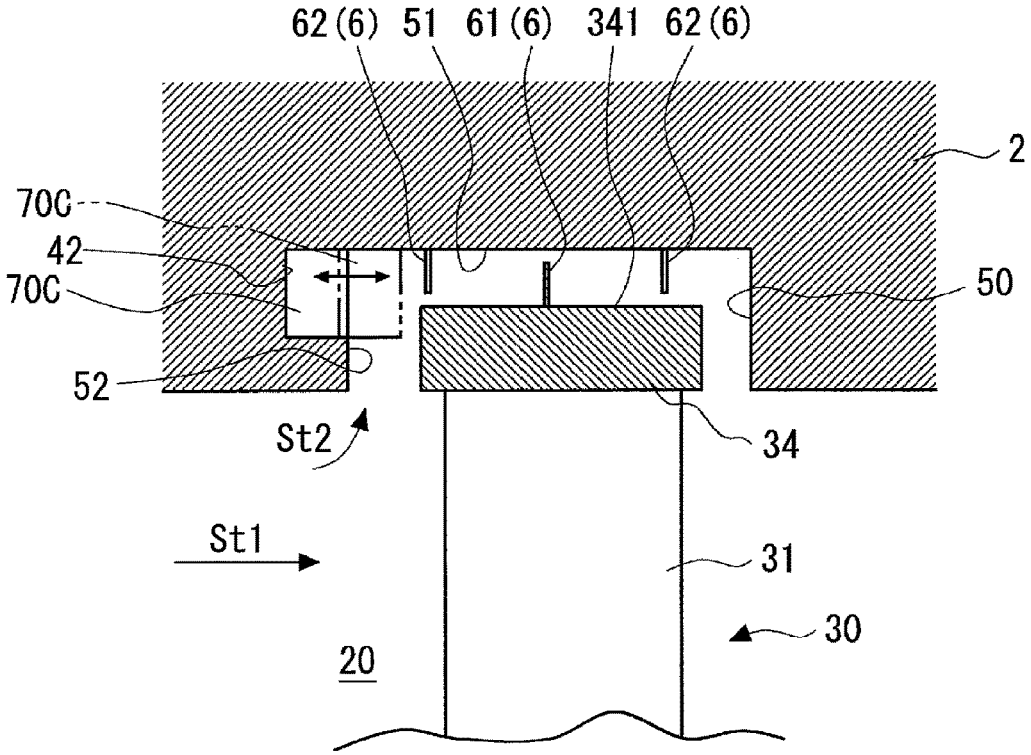
FIG. 11 is a view of a variable breaker according to a third embodiment of the present invention as seen in the radial direction.

Subsequently, a third embodiment of the present invention will be described with reference to FIG. 11. The same reference signs will be assigned to the same components as in the embodiments, and a detailed descriptions thereof will be omitted. As shown in the same drawing, in the embodiment, an accommodation groove 42 is formed in the recessed portion upstream surface 52, and extends in the direction of the axis O. More specifically, the accommodation groove 42 is formed alongside of an edge of the recessed portion upstream surface 52, which is positioned on the outside in the radial direction. The accommodation groove 42 can accommodate a variable breaker 70C having a rectangular plate-like shape.

The variable breaker 70C can be displaced between an accommodation position where the variable breaker 70C is accommodated in the accommodation groove 42 and a protrusion position where the variable breaker 70C protrudes downstream from the accommodation groove 42. That is, the variable breaker 70C can advance and retract into the accommodation groove 42 in the direction of the axis O. When the variable breaker 70C is at the protrusion position, the accommodation groove 42 supports an upstream (on one side in the direction of the axis O) edge of the variable breaker 70C. Similar to the embodiments, also in the embodiment, a plurality of the variable breakers 70C are provided inside the recessed portion 50 while being equally spaced from each other in the peripheral direction.

According to the configuration, the variable breaker 70C advances and retracts from the inside of the recessed portion 50 in the direction of the axis O. A flow (swirl component) containing a peripheral component with respect to the axis O is formed inside the recessed portion 50. Therefore, when the variable breaker 70C is at the protrusion position, it is possible to efficiently block the swirl component via the variable breaker 70C. On the other hand, when the variable breaker 70C is accommodated at the accommodation position, because the swirl component is not blocked, it is possible to operate the steam turbine 1 at the same output as that of a turbine without swirl breakers installed.

The third embodiment of the present invention has been described above. Various forms of modifications or improvements can be made to the configuration without departing from the spirit of the present invention. In the embodiment, it is possible to selectively displace the variable breaker 70C between the accommodation position and the protrusion position. However, it is also possible to continuously change an advance amount of the variable breaker 70C between the accommodation position and the protrusion position. According to such configuration, it is possible to more precisely adjust a decrease amount of the swirl component.

In the embodiment, the steam turbine 1 is an example of a rotary machine. However, the form of the rotary machine is not limited to the steam turbine 1, and the rotary machine may be a centrifugal compressor or a gas turbine.

Fourth Embodiment

Figure 12:
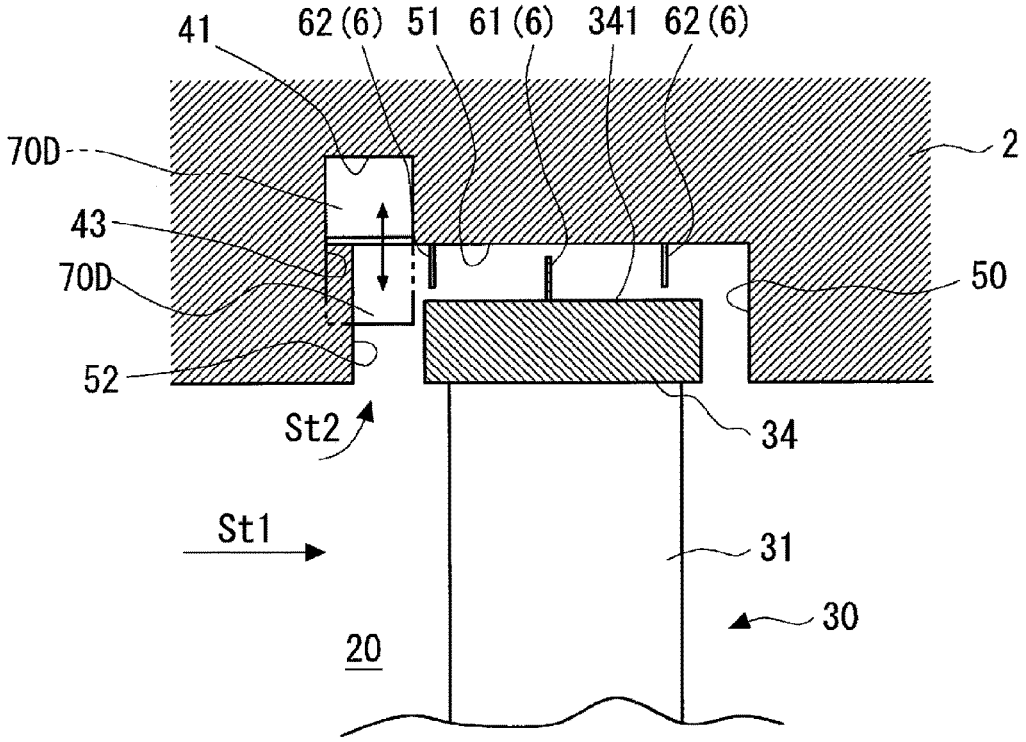
FIG. 12 is a view of a variable breaker according to a fourth embodiment of the present invention as seen in the radial direction.

Subsequently, a fourth embodiment of the present invention will be described with reference to FIG. 12. The same reference signs will be assigned to the same components as in the embodiments, and detailed descriptions thereof will be omitted. As shown in the same drawing, in the embodiment, similar to the second embodiment, the accommodation groove 41 is formed in the recessed portion bottom surface 51, and extends in the radial direction with respect to the axis O. More specifically, the accommodation groove 41 is formed alongside of an upstream edge of the recessed portion bottom surface 51. The accommodation groove 41 can accommodate a variable breaker 70D having a rectangular plate-like shape.

The variable breaker 70D can be displaced between an accommodation position where the variable breaker 70D is accommodated in the accommodation groove 41 and a protrusion position where the variable breaker 70D protrudes inward from the accommodation groove 41 in the radial direction. That is, the variable breaker 70D can advance and retract into the accommodation groove 41 in the radial direction. A fixing groove 43 is formed in the recessed portion upstream surface 52, and communicates with the accommodation groove 41 in the radial direction. The fixing groove 43 extends in the radial direction with respect to the axis O, and accommodates at least part of the variable breaker 70D at the protrusion position. Specifically, the fixing groove 43 accommodates part of the variable breaker 70D, which contains an upstream edge of the variable breaker 70D. That is, the variable breaker 70D at the protrusion position is supported from the outside in the radial direction by the accommodation groove 41, and from the upstream side by the fixing groove 43.

According to the configuration, the variable breaker 70D advances and retracts from the inside of the recessed portion 50 in the radial direction with respect to the axis O. A flow (swirl component) containing a peripheral component with respect to the axis O is formed inside the recessed portion 50. Therefore, when the variable breaker 70D is at the protrusion position, it is possible to efficiently block the swirl component via the variable breaker 70D. On the other hand, when the variable breaker 70D is accommodated at the accommodation position, because the swirl component is not blocked, it is possible to operate the steam turbine 1 at the same output as that of a turbine without swirl breakers installed.

According to the configuration, when the variable breaker 70D is at the protrusion position, at least part of the variable breaker 70D is fixed to the fixing groove 43 such that the variable breaker 70D cannot be displaced in the peripheral direction. Therefore, the variable breaker 70D can sufficiently resist the swirl component colliding with the variable breaker 70D in the peripheral direction. In other words, it is possible to reduce the possibility that the variable breaker 70D is blown away or bent by the swirl component.

The fourth embodiment of the present invention has been described above. Various forms of modifications or improvements can be made to the configuration without departing from the spirit of the present invention. In the embodiment, it is possible to selectively displace the variable breaker 70D between the accommodation position and the protrusion position. However, it is also possible to continuously change an advance amount of the variable breaker 70D between the accommodation position and the protrusion position. According to such configuration, it is possible to more precisely adjust a decrease amount of the swirl component.

Figure 13:
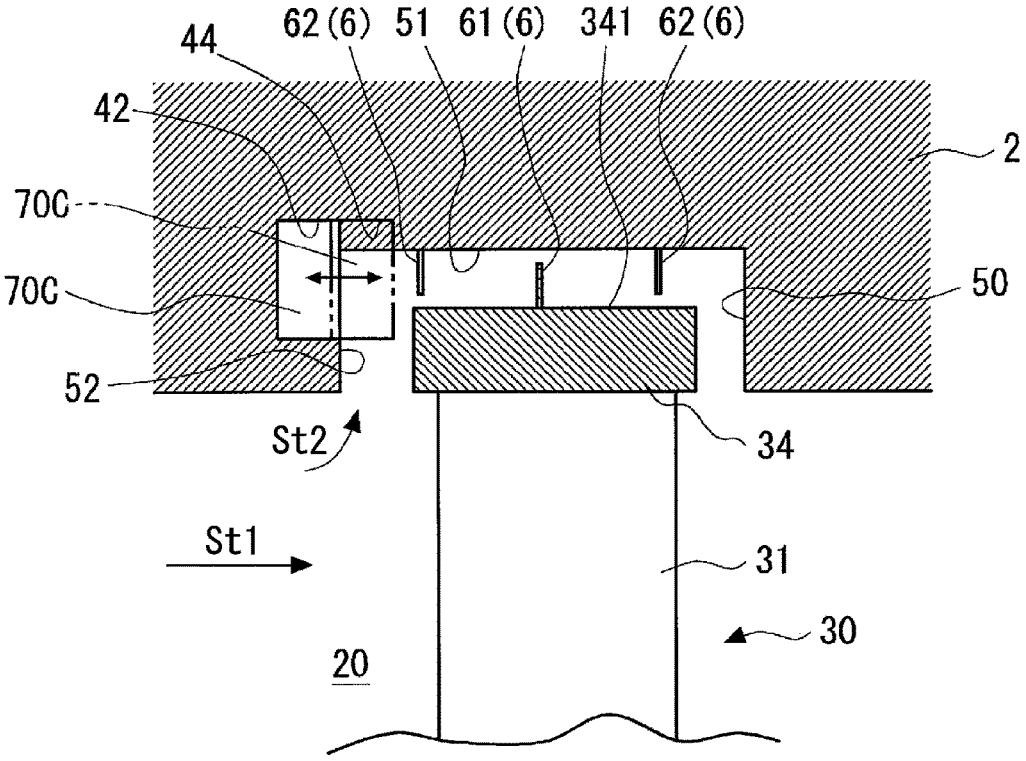
FIG. 13 is a view showing a modification example of the variable breaker according to the first embodiment of the present invention.

As shown in FIG. 13, the fixing groove 43 can be applied to the variable breaker 70C described in the third embodiment. As shown in the same drawing, a fixing groove 44 is formed in the recessed portion bottom surface 51, and communicates with the accommodation groove 42 in the radial direction. The fixing groove 44 extends in the radial direction with respect to the axis O, and accommodates at least part of the variable breaker 70C at the protrusion position. That is, the variable breaker 70C at the protrusion position is supported from the outside in the radial direction by the accommodation groove 42, and from the upstream side by the fixing groove 44.

In the embodiment, the steam turbine 1 is an example of a rotary machine. However, the form of the rotary machine is not limited to the steam turbine 1, and the rotary machine may be a centrifugal compressor or a gas turbine.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

EXPLANATION OF REFERENCES

1: steam turbine
2: casing
3: rotor
4: journal bearing
5: thrust bearing
6: sealing fin
11: shaft end
12: steam supply pipe
13: steam exhaust pipe
20: main flow passage
24: stator blade base
30: rotor blade
31: blade body
34: rotor blade shroud
40, 41, 42: accommodation groove
43, 44: fixing groove
50: recessed portion
51: recessed portion bottom surface
52: recessed portion upstream surface
61: shroud side sealing fin
62: recessed portion side sealing fin
70: variable breaker
71: pivotal shaft
72: driving source
73: breaker main surface
80: vibration sensor
81: controller
82: vibration detection unit
83: determination unit
84: driving control unit

90: control device
91: CPU
92: ROM
93: RAM
94: HDD
95: signal receiving module
L: signal line
O: axis
St1: main steam
St2: leakage flow

What is claimed is:

1. A rotary machine comprising:

a rotary shaft configured to rotate around an axis;

a plurality of rotor blades extending outward from the rotary shaft in a radial direction of the rotary shaft and are provided with gaps therebetween in a peripheral direction of the rotary shaft;

a casing surrounding the rotor blades radially outside the rotor blades, and in which a recessed portion as a cavity accommodates tips of the rotor blades;

a sealing portion extending from one of a bottom portion of the recessed portion and the tip of the rotor blade, and having a clearance with the other; and a variable breaker installed in the casing and is capable of being displaced between a protrusion position where the variable breaker protrudes into the cavity and an accommodation position where the variable breaker is accommodated in the casing, wherein an accommodation groove in which the variable breaker is accommodated is formed in the recessed portion of the casing, and the variable breaker is supported so as to be capable of being displaced between an accommodation position where the variable breaker is accommodated in the accommodation groove and a protrusion position where the variable breaker is protruded from the accommodation groove.

2. The rotary machine according to claim 1, wherein the variable breaker is capable of pivoting around a pivotal shaft extending in the radial direction with respect to the axis.

3. The rotary machine according to claim 1, wherein the variable breaker is capable of retractably advancing from the inside of the casing into the cavity in the radial direction with respect to the axis.

4. The rotary machine according to claim 3, wherein the casing is provided with a fixing groove extending in the radial direction with respect to the axis, and when the variable breaker is at the protrusion position, at least part of the variable breaker is restricted by the fixing groove.

5. The rotary machine according to claim 1, wherein the variable breaker is capable of retractably advancing from the inside of the casing into the cavity in a direction of the axis.

6. The rotary machine according to claim 5, wherein the casing is provided with a fixing groove extending in the radial direction with respect to the axis, and when the variable breaker is at the protrusion position, at least part of the variable breaker is restricted by the fixing groove.

7. The rotary machine according to claim 1, wherein a plurality of the variable breakers are installed such that the variable breakers are equally spaced from each other in the peripheral direction with respect to the axis.

8. The rotary machine according to claim 1, further comprising:

a vibration detection unit configured to detect vibration of the rotary shaft; and a control device configured to displace the variable breaker to the protrusion position when the vibration of the rotary shaft is detected, and to displace the variable breaker to the accommodation position when the vibration of the rotary shaft is not detected.

9. The rotary machine according to claim 8, wherein the control device determines the number of the variable breakers, which are to be displaced to the protrusion position, in response to an intensity of the vibration of the rotary shaft.

10. The rotary machine according to claim 9, wherein, as the intensity of vibration of the rotary shaft increases, the control device configured to increase the number of the variable breakers which are to be displaced from the accommodation position to the protrusion position, and to displace a plurality of the variable breakers to the protrusion position such that the variable breakers are equally spaced from each other in the peripheral direction.

11. The rotary machine according to claim 1, wherein the variable breaker has a triangular cross section as seen in the radial direction.

* * * * *